US007646356B2

(12) United States Patent
Adel et al.

(10) Patent No.: US 7,646,356 B2
(45) Date of Patent: Jan. 12, 2010

(54) DOUBLE SPIRAL ANTENNA

(75) Inventors: Hans Adel, Stein (DE); Rainer Wansch, Hagenau (DE); Josef Bernhard, Erlangen (DE); Thomas Fischer, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 40 days.

(21) Appl. No.: 11/884,691

(22) PCT Filed: Feb. 14, 2006

(86) PCT No.: PCT/EP2006/001335

§ 371 (c)(1),
(2), (4) Date: Jun. 2, 2008

(87) PCT Pub. No.: WO2006/089666

PCT Pub. Date: Aug. 31, 2006

(65) Prior Publication Data

US 2008/0272980 A1 Nov. 6, 2008

(30) Foreign Application Priority Data

Feb. 22, 2005 (DE) ..... 10 2005 008 063

(51) Int. Cl.
*H01Q 1/36* (2006.01)
*H01Q 13/10* (2006.01)

(52) U.S. Cl. ..... 343/895; 343/767; 343/770

(58) Field of Classification Search ..... None
See application file for complete search history.

(56) References Cited

U.S. PATENT DOCUMENTS

| | | | | |
|---|---|---|---|---|
| 4,387,379 | A * | 6/1983 | Hardie | 343/895 |
| 6,130,652 | A | 10/2000 | Goetz et al. | |
| 6,362,796 | B1 * | 3/2002 | Bohlman | 343/895 |
| 6,466,177 | B1 * | 10/2002 | Kunysz | 343/769 |
| 6,922,179 | B2 * | 7/2005 | McCollum | 343/895 |
| 7,391,383 | B2 * | 6/2008 | Schantz | 343/767 |
| 2001/0048399 | A1 | 12/2001 | Oberschmidt et al. | |
| 2003/0006938 | A1 | 1/2003 | Nesic et al. | |
| 2003/0122713 | A1 | 7/2003 | Morris et al. | |
| 2008/0095387 | A1 | 4/2008 | Niederdrank et al. | |

FOREIGN PATENT DOCUMENTS

| | | | |
|---|---|---|---|
| EP | 1 158 606 | A1 | 11/2001 |
| EP | 1 271 692 | A1 | 1/2003 |
| EP | 1 389 035 | A2 | 2/2004 |
| EP | 1 465 457 | A2 | 10/2004 |
| JP | 62216407 | A | 9/1987 |

* cited by examiner

*Primary Examiner*—Trinh V Dinh

(57) ABSTRACT

An antenna comprises a first antenna element, which has a first helix, and a second antenna element, which has a second helix. The first and the second antenna elements each have a feed point at an outer end of the corresponding helix and an open end at an inner end of the corresponding helix. A symmetrical helix antenna according to the invention can be integrated in a comparatively simple manner in an existing system, for example in a hearing aid. By integrating the antenna in a plastic housing, the antenna cannot be seen at all from the outside. The antenna is comparatively small in relation to conventional antennas.

16 Claims, 5 Drawing Sheets

DOUBLE SPIRAL ANTENNA

CROSS REFERENCE TO RELATED APPLICATIONS

This application is the US National Stage of International Application No. PCT/EP2006/001335 filed Feb. 14, 2006 and claims the benefits thereof. The International Application claims the benefits of German application No. 10 2005 008 063.4 filed Feb. 22, 2005, both of the applications are incorporated by reference herein in their entirety.

FIELD OF THE INVENTION

The present invention relates in general to an antenna, in particular to an antenna for wireless data transmissions to a hearing aid.

BACKGROUND OF THE INVENTION

There are presently numerous portable devices from which and to which data is to be transmitted by wireless means. One possibility which suggests itself here is to realize the data transmission by electromagnetic coupling. In doing this, particular difficulties arise if the devices used are very small, because in such a situation there are problems in integrating an antenna structure into the device concerned. An important example of a very small device for which wireless data transmission is required is a hearing aid.

In accordance with the prior art, the transmission of data to a hearing aid is often realized in practice by inductive transmission links. For this purpose, an induction loop is integrated into the hearing aid. However, this type of inductive transmission of speech or data, as applicable, to a hearing aid requires special installations in the area concerned, where the wireless transmission of speech or data is to take place.

In another form of embodiment of wireless radio transmission systems, magnetic antennas are used in the hearing aids. These essentially couple into the magnetic components of an electromagnetic field, and are generally designed as conductive loops. Radio transmission systems of this type generally work at frequencies which are significantly lower than the frequencies used in mobile radiocommunications, e.g. in the VHF band at 174 MHz.

European patent application EP 1 326 302 A2 describes a fractal antenna structure which is realized on an integrated circuit, and which can be used in a hearing aid. However, the fractal antennas described in the document cited can only be considered for significantly higher frequencies.

SUMMARY OF THE INVENTION

It is the object of the present invention to devise an antenna, which can be integrated into a portable device, and which has smaller maximum geometric dimensions than a dipole antenna for the corresponding frequency.

This object is achieved by an antenna as claimed in the claims.

The present invention creates an antenna with a first radiator, which has a first spiral, and a second radiator, which has a second spiral, where the first radiator has a first feed point at an outer end of the first spiral and has an open end at an inner end of the first spiral, and where the second radiator has a second feed point at an outer end of the second spiral and has an open end at an inner end of the second spiral.

The central thought behind the present invention is that the maximum dimensions of a linear antenna can be reduced by making both radiators in the form of a spiral. In this case, each of the two radiators has one feed point which is sited at the outer end of the spiral concerned. On the other hand, the inner ends of the two spirals are open circuits. In contrast to a simple shortening of the two radiators, curling up the two radiators results in an antenna with an input impedance which can without problem be matched to the transmission powers or to the transmitting and receiving stages, as applicable, used in practice.

An antenna design in accordance with the invention thus enables it to be fully integrated into a mobile device which has wireless data transmission. Because of its small dimensions and the flexibility of its geometric layout, the antenna structure in accordance with the invention can then be integrated into a plastic housing. It is thus possible to design an antenna which is completely invisible from outside. It should further be emphasized that on its feed points, an antenna in accordance with the invention has essentially symmetrical electrical characteristics in relation to a fixed external reference potential. The feed to the antenna can have a symmetrical layout, enabling interference in a receiving section to be reduced. An antenna layout in accordance with the invention also enables the antenna structure to be realized as a slot antenna in a metal surface. This is possible because of the duality principle, and allows the maximum possible flexibility in the design of an antenna.

In a preferred form of embodiment of the antenna in accordance with the invention, the gap between the first feed point and the second feed point is at least 0.005 times the freespace wavelength at an operating frequency for which the antenna is designed. Such a gap between the feed points ensures that the input impedance of the antenna lies in a technically advantageous range, so that impedance matching can be effected by simple means. Furthermore, a gap between the feed points of more than $5*10^{-3}$ times the freespace wavelength ensures good reproducibility of the antenna structure.

With a preferred form of embodiment, the gap between the center of gravity of the first spiral and the center of gravity of the second spiral is greater than the hypotenuse of a right-angled triangle in which the first cathete has a length equal to half the diameter of the first spiral and in which the second cathete has a length equal to half the diameter of the second spiral. Here, the center of gravity of a spiral is defined as the geometric center of gravity of a line which follows the course of the spiral. The diameter of a spiral is defined as the maximum distance between any two points which lie on the spiral. An appropriate design of the antenna ensures that the first spiral and the second spiral have an adequate gap between them, and that no excessively strong direct coupling exists between the two spirals. Because, specifically in the case of very small geometries, a strong coupling between the two spirals reduces the effectiveness of the radiation and leads to an unfavorable feed point impedance.

In a further exemplary embodiment, the antenna is so designed that a parallel projection of a first spiral substrate area in the direction of the first spiral axis misses a second spiral substrate area, and that a parallel projection of the second spiral substrate area in the direction of the second spiral axis misses the first spiral substrate area. Here, a spiral substrate area is defined as the area bounded by the outermost spiral turn of a spiral, forming one single contiguous area with the minimum possible area. In other words, a spiral substrate area is an area with an approximately circular shape which is suitable for carrying a spiral. A spiral axis can be constructed by approximating the spiral section by section by a circle, and by then forming a normal vector which is perpendicular to the plane in which the approximating circle lies. Averaging these normal vectors for the various sections of the spiral then gives the direction of the spiral axis. If the spiral lies in a plane, then the direction of the spiral axis is simply that of the normal to this plane. On the other hand, if the spiral lies on a curved surface, then the spiral axis is approximately equal to the average of the normals to the surface over the area in which the spiral is located. Such a design for the antenna ensures that the antenna functions as an electric dipole with the ability to radiate, and that the two spirals are not arranged approximately parallel to each other.

In the case of a further preferred exemplary embodiment, the first radiator and the second radiator are electrically conductive structures. However, it is just as well possible that the first radiator and the second radiator are radiating slots, which are surrounded by a conductive structure. It is thus also possible to make an antenna arrangement in accordance with the invention in the form of a slot antenna, in accordance with the principle of duality.

In a manner in accordance with the invention, the radiators of an antenna are thus formed by coiling up the two arms of an extended linear radiator to form a first spiral and a second spiral. Here, the coiling up is to be regarded not in the physical sense of how the material is processed, but as a procedure in the designing of the antenna, so that as defined even a metallization layer, a flat metal foil, a wire or any comparable conductive material can be considered to be coiled up. The same applies for a slot in a conductive structure. The manufacturing technology of the processing can be, for example, coating in conjunction with photolithographic structuring, cutting, stamping or some other manufacturing method. It should further be emphasized that the two arms of the extended linear radiator are not coiled up jointly, but separately from each other. Hence, the two spirals, which form the first radiator and the second radiator, are not coiled together or intercoiled, as applicable, but are present as separate spirals. They are thus spatially apart.

The first spiral and the second spiral have, preferably, the same directional sense of coiling or circulation or rotation, as applicable. The result of this, at least approximately, is a point symmetry of the arrangement, leading to particularly advantageous radiation characteristics for the antenna. In order to determine the circulation sense, two spirals which do not lie within a plane are mapped by a parallel projection onto a plane, where the parallel projection rays all run in the same direction and have the same orientation. The sense of the circulation of the projection then represents the circulation sense of the two spirals. Two spirals in a plane then have the same circulation sense if, when the two spirals are followed from their inner ends to their outer ends, each of them has the same qualitative curvature characteristic (curved to the left or curved to the right).

It is further preferred that the design of the antenna is such that in relation to a reference potential it has essentially symmetrical electrical behavior at the first feed point and the second feed point. This enables the antenna to be fed symmetrically and, by comparison with asymmetric antennas, renders superfluous a large reference potential area. It is advantageous to avoid an extended reference potential area, in particular for very small devices, because in this case their dimensions are smaller than the wavelength of the transmission frequencies used, and because such devices often have no large metallic or metallized housing components.

It is further preferred that the first radiator and the second radiator are formed on the surface of a dielectric material. Namely, because it has been found that applying an antenna structure in accordance with the invention onto a dielectric substrate does not significantly degrade the antenna characteristics. The use of a substrate is advantageous because this not only improves the mechanical robustness of the antenna compared to a self-supporting metallized structure, but also makes manufacture easier. Namely because it is then possible, for example, to apply the metallic structures onto the surface of the dielectric material by a coating process (e.g. vapor deposition, lamination, bonding), followed by structuring them. So it is unnecessary to manufacture separately a metallized structure, which would be very difficult to handle and lacking in mechanical robustness.

It is further preferred that the surface of the dielectric material, on which the first radiator and the second radiator are formed, is domed. There is then no problem in being able to adapt the antenna structure in accordance with the invention to the topology of an existing surface. This is particularly important in the realization of an antenna on or in the housing of a device, where the shaping of the housing must generally take into account numerous criteria.

Apart from this, it is advantageous to integrate the first radiator and the second radiator into the housing of an electronic device which is made of a dielectric material and which houses an electric circuit. It is, indeed, not only possible to apply the antenna structure in accordance with the invention to the surface of a dielectric substrate, but it is also possible to integrate it into the substrate, i.e. the housing. Such a design can bring very major advantages with many applications, firstly because it protects the antenna against external influences and damage, and secondly because the antenna is no longer visible from outside. The radiation characteristics of the antenna are not significantly degraded if the housing is thin enough.

It has further been found that the antenna in accordance with the invention can with advantage be arranged on the surface of a housing which is part of a behind-the-ear hearing aid. Such a behind-the-ear hearing aid is typically designed to be worn behind the pinna of a person's ear. It has been found that the adaptation and radiation characteristics of an antenna in accordance with the invention are good even in this difficult operating environment.

Finally, it is preferred that the working frequency of an antenna in accordance with the invention lies between 500 MHz and 6 GHz. It is further preferred that the antenna has a maximum dimension of less than 10 cm. This enables the antenna in accordance with the invention to be used in portable devices.

It is further advantageous if the antenna has a maximum dimension of less than one fifth of the freespace wavelength at an operating frequency at which the antenna is operated. In this case, the spiral is tightly enough coiled to achieve a suitable field distribution. Incidentally, by comparison with a conventional dipole antenna the size advantage of an antenna in accordance with the invention comes most strongly to the fore when the antenna is small compared to the freespace wavelength.

BRIEF DESCRIPTION OF THE DRAWINGS

Preferred exemplary embodiments of the present invention are explained in more detail below with reference to the attached drawings. These show.

DETAILED DESCRIPTION OF THE INVENTION

Figure 1:
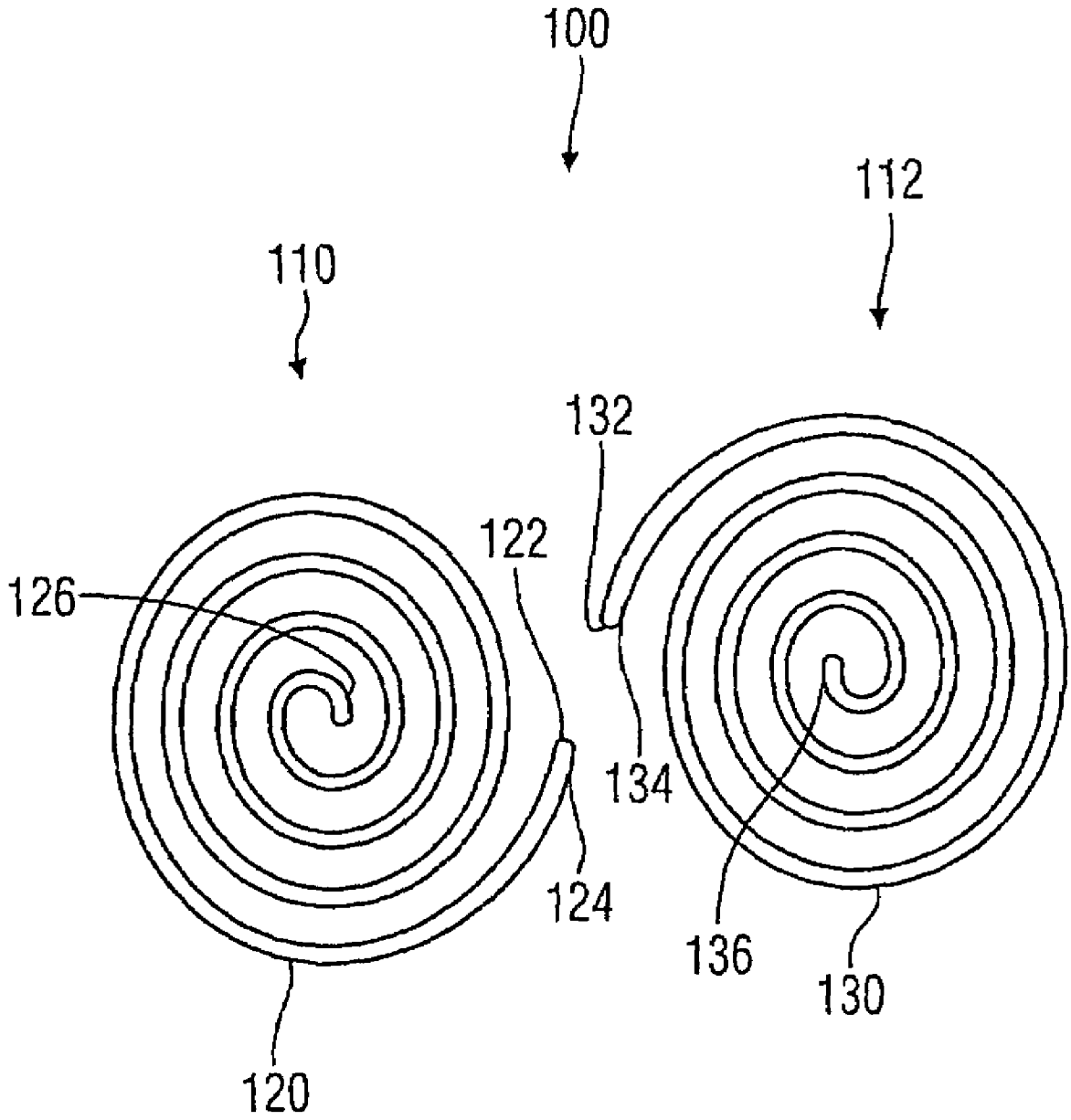
FIG. 1 a schematic representation of an antenna in accordance with the invention, in accordance with a first exemplary embodiment of the present invention.

FIG. 1 shows a schematic diagram of an antenna in accordance with the invention, in accordance with a first exemplary embodiment of the present invention. The antenna in its entirety is labeled 100. It has a first radiator 110 together with a second radiator 112. The first radiator 110 has a first spiral 120 together with a first feed point 122. The first feed point 122 is located at the outer end 124 of the first spiral 120. On the other hand, the inner end 126 of the first spiral 120 is open circuit. The second radiator 112 is constructed similarly to the first radiator 110, and has a second spiral 130 together with a second feed point 132. The second feed point 132 is arranged at the outer end 134 of the second spiral 130. The inner end 136 of the second spiral 130 is open circuit.

The first radiator 110 and the second radiator 112 will preferably be an electrically conductive arrangement. However, it is also possible to use a radiating slot which is surrounded by a conductive structure, for example a metallization. If the radiator is formed by a conductive structure, this can be manufactured using numerous technologies. For example, the spirals 110, 112 can be formed from an appropriately shaped wire. Equally well, a processed foil of conductive material (e.g. copper foil) can be used to manufacture the conductive spirals. Further, the radiator structure can be formed by a thin conductive layer which has been applied to a substrate during manufacture and has then structured.

The conductive structure can either be self-supporting (i.e. only fixed at one or a few fixing points) or can be applied to a substrate. It is, incidentally, not necessary that the two radiators 110, 112 lie in one plane. Rather, they can be inclined to each other, or their track can be adapted to fit a curved surface, provided that the graph of the electrical and magnetic field lines does not basically change compared to the exemplary embodiment shown.

The two radiators 110, 112 can be connected to a transmission link or associated circuitry at the feed points 122, 132. In the exemplary embodiment shown, these lie at the outer end 124 of the first spiral 120 and at the outer end 134 of the second spiral 130. The connection can be made, for example, via a pair of wires which lie in the same plane or on the same material surface, as applicable, as the two radiators 110, 112 themselves. Apart from this however, it is also possible that the feed is made at right angles to the plane or surface, as applicable, in which the two radiators 110, 112 lie. For this purpose, there may for example be through-contacts (feedthroughs) at the outer ends 124, 134 of the two spirals 120, 130. It is also possible to have hybrid solutions, in which some part of the feed structure lies in the plane of a radiator and another part of the feed structure is arranged outside this plane or surface. It is also entirely possible to have feed lines which are oriented at an angle to the plane of the antenna. Incidentally, the feed structure can incorporate matching circuits (e.g. wires with varying thickness, matching stubs or lumped elements). Apart from this it is possible that the spirals are not connected at their outermost ends, but at a distance from the end. It is possible by this means to effect any required impedance matching if this has not already been achieved by the geometry of the radiators. In relation to such a form of embodiment, the outer end of the spiral is not to be regarded in a narrow geometric sense as a point, but rather as a region which extends from the outermost end of the spiral towards the inner end of the spiral for about 1/10 of the freespace wavelength, measured along the track of the spiral.

If the radiator is in the form of a radiating slot, then the connection can be made via any desired arrangement which is suitable for the excitation of a slot antenna, where the feed structure is matched to the feed point impedance of the slot antenna, or is arranged to achieve impedance transformation to a preferred impedance.

It is furthermore possible that the width of the spirals varies from the outer end to the inner end. In particular it is possible, depending on the application situation, that the width of the spirals (i.e. the width of the conductive structure or the radiating slot) at the inner ends 126, 136 is greater than or smaller than the width of the spirals at their outer ends 124, 134. By such means it is possible, for example, to improve the impedance characteristics or the bandwidth of the antenna.

In the case shown, of the exemplary embodiment 100 of an antenna in accordance with the invention, the two spirals 120, 130 have the same circulation sense. However, it is also possible that the circulation sense of one spiral is changed, so that the two spirals 120, 130 which form the antenna have opposing circulation senses.

On the basis of the structural description, the way that an antenna in accordance with the invention functions is described below.

The antenna in accordance with the invention is based on a dipole antenna, with the arms of a linear dipole antenna being coiled up into spirals 120, 130. By this means, the maximum dimension of the antenna is reduced by comparison with an extended dipole antenna. Because the antenna in accordance with the invention is essentially based on a dipole antenna, it is a symmetrical antenna. The electrical characteristics at the feed points 122, 132 is thus essentially symmetrical with respect to a reference potential, whereby any geometric asymmetries which there may be do admittedly affect the electrical characteristics.

The way in which the present antenna works can be understood roughly by starting with a conventional dipole antenna with reduction coils. However, in the case of an antenna in accordance with the present invention, the entire dipole is coiled up. The coiling axis is here approximately perpendicular to the plane or the area in which the spiral concerned lies. By contrast, conventional reduction coils are constructed either as lumped elements or as a number of windings, and are mostly arranged close to the feed point, whereby the radiation essentially emanates from the remaining extended dipole.

On the other hand, in the case of an antenna in accordance with the invention, the split between a region which is coiled up for the purpose of geometric shortening and an extended radiator is eliminated. Rather, a complete dipole is coiled up.

If an antenna geometry in accordance with the present invention is used, the particularly favorable field distribution means that the effect thereby achieved includes, from the point of view of its efficiency, a matching of the antenna to conventional waveguide impedances.

By this means, in spite of the small geometric dimensions of the antenna, an adequate radiation efficiency can be achieved. It is furthermore possible to avoid a large part of the transmission power being lost in a matching network.

The antenna in accordance with the invention can be used self-supporting, can be applied to a substrate, or integrated into a plastic housing. In this case, it has been found that if the antenna in accordance with the invention is assembled in a plastic housing or on a plastic housing this does not involve any unacceptable deterioration in the electrical characteristics. Hence the antenna in accordance with the invention is well suited, for example, for use in small portable devices such as hearing aids, pagers and mobile telephones.

Figure 2:
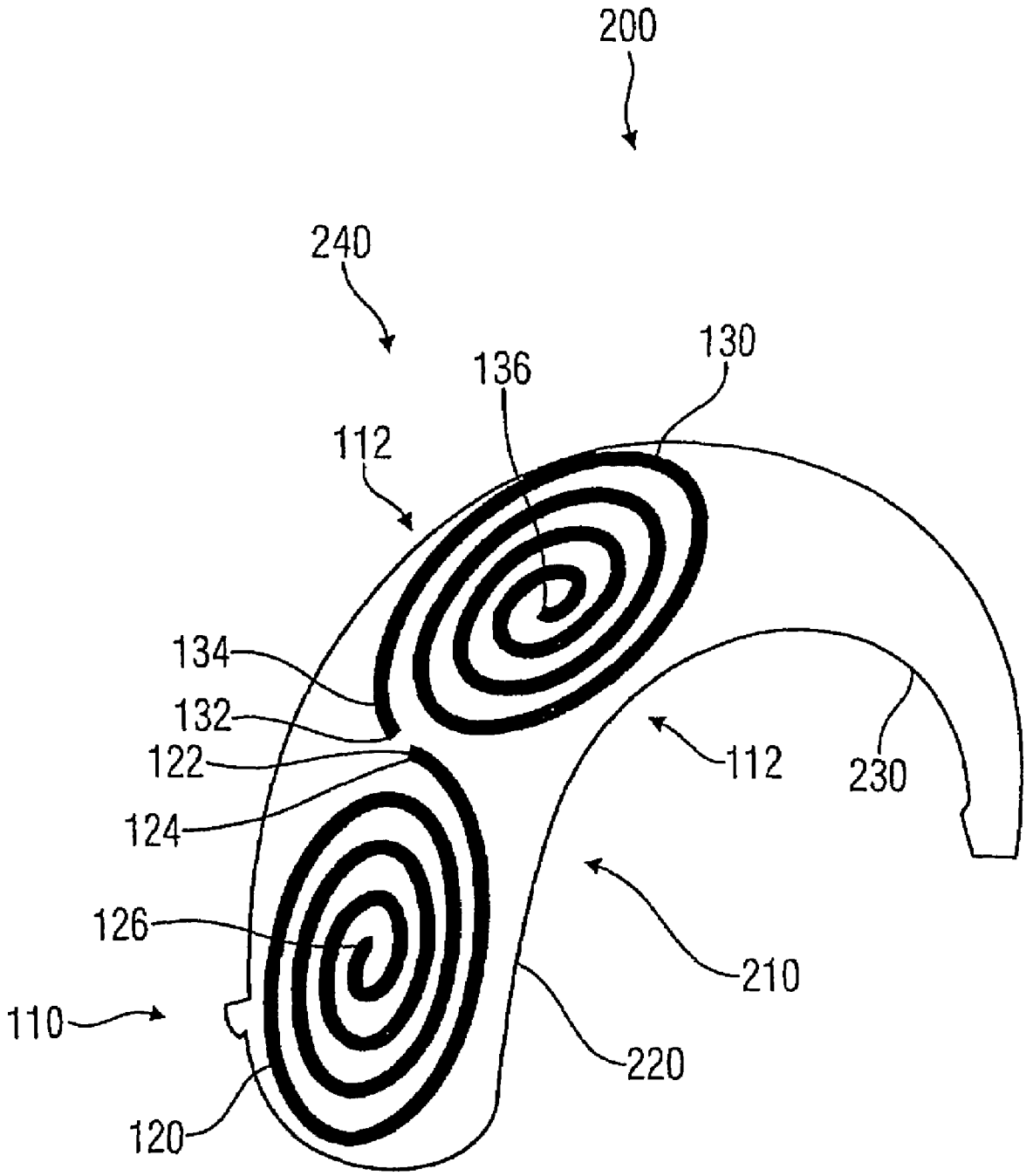
FIG. 2 a schematic representation of an antenna in accordance with the invention, in accordance with a second exemplary embodiment of the present invention, arranged on the housing of a hearing aid.

FIG. 2 shows a schematic diagram of an antenna in accordance with the invention, in accordance with a second exemplary embodiment of the present invention, arranged on the housing of a hearing aid. The entirety of the arrangement is labeled 200.

The arrangement 200 shown includes a spiral antenna 210 which is applied to the hearing aid body 220 of a hearing aid 240. Together with the ear mold 230 and the spiral antenna 210, the hearing aid body 220 forms the hearing aid 240.

The spiral antenna 210 consists of two radiators 110, 112. Since the spiral antenna 210 corresponds in its components to the spiral antenna 100 described by reference to FIG. 1, the same elements in FIG. 1 and FIG. 2 are labeled with the same reference marks, and are not explained here in any more detail.

The arrangement 200 thus shows how a spiral antenna 210 in accordance with the invention can be built onto a hearing aid 240. It is worth remarking about this that the two spirals 120, 130 can be adapted to the shape of the hearing aid body 220.

In the case of the realization shown, the spiral antenna 210 is applied to the outer side of the hearing aid body 220. However, it is equally well possible to form the antenna on the inner side of the hearing aid housing. It is also conceivable that the spiral antenna 210 is embedded between several layers of the hearing aid housing so that, for example, a protective layer protects the spiral antenna 210. The protective layer can at the same time be used to adapt the appearance of the hearing aid 240 to the user's preferences.

The spiral antenna 210 in conjunction with the hearing aid 240 will preferably be designed to receive a speech or data signal which is transmitted wirelessly, and to pass it on to the electronics in the hearing aid. Here, a speech signal which is received can be output via the ear mold 230 to the auditory canal of a user of the hearing aid 240. Data signals which are transmitted wirelessly can further be used to influence the settings of the hearing aid 240 and, for example, to adjust them according to the user's preferences.

The spiral antenna 210 can be used both for transmitting and also for receiving. For example, it may be desirable to transmit status data from the hearing aid to a receiver. Because of the reciprocity, the spiral antenna 210 can be used both as a transmitting antenna and also as a receiving antenna, where transmission and reception can take place simultaneously or in time multiplex.

For appropriate applications, it is preferred that the spiral antenna is designed for an operating frequency lying between 500 MHz and 6 GHz. For example, it is advantageous to use the ISM band at 868 MHz. It is also possible to use, for example, frequency bands which are reserved for medical applications.

When a spiral antenna 210 in accordance with the invention is used in conjunction with a hearing aid 240, or with other mobile transmission and/or reception devices such as pagers and mobile telephones, the size of the complete spiral antenna structure is restricted to less than 10 cm. However, it has been found that the antenna structure in accordance with the invention has adequately good characteristics in spite of the small dimensions. It has furthermore been found that, when used in conjunction with a hearing aid, the overall size of the antenna structure should not be less than 1/16 of the freespace wavelength at an operating frequency of the antenna, if 1/16 of the freespace wavelength is less than 2 cm. If, at low frequencies, 1/16 of the freespace wavelength is greater than 2 cm (i.e. the freespace wavelength is greater than 32 cm), then the overall size of the antenna structure should preferably be at least 2 cm. The antenna must therefore in every case, even at low frequencies below 1 GHz, be smaller than the hearing aid. An overall size of antenna structure of about $\lambda/5$ has been shown to be especially advantageous because this gives the best possible compromise between the space occupied by the antenna and the radiation characteristics.

Figure 3:
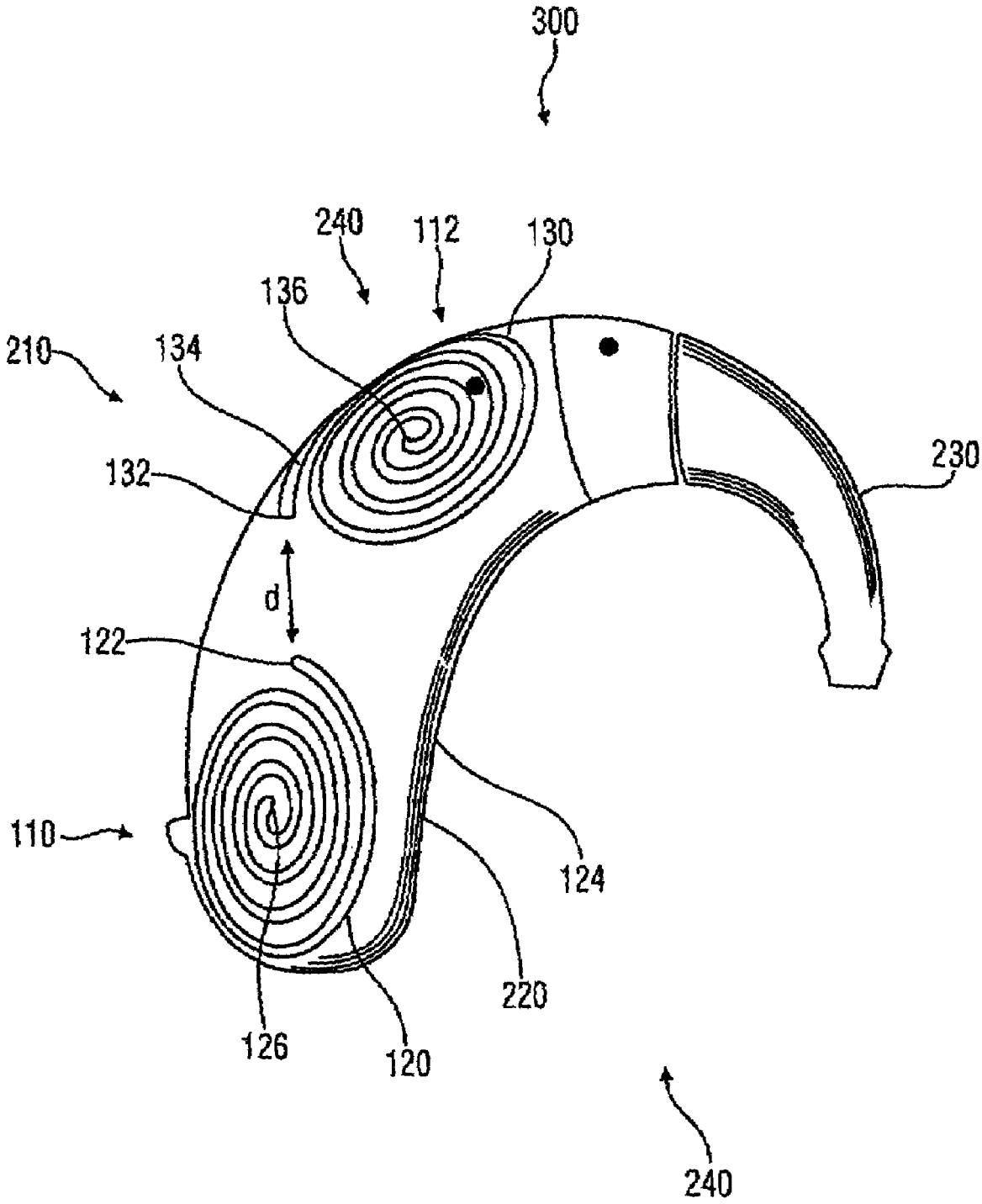
FIG. 3 a photographic image of a prototype of an antenna in accordance with the invention, in accordance with the second exemplary embodiment of the present invention, arranged on the housing of a hearing aid.

FIG. 3 shows a photographic image of a prototype of an antenna in accordance with the invention in accordance with the second exemplary embodiment of the present invention, arranged on the housing of a hearing aid. The entirety of the arrangement is labeled 300. Since the arrangement is essentially the same as the arrangements 100, 200 shown in FIG. 1 and FIG. 2, the same elements are here labeled with the same reference marks as for the arrangements 100, 200 described above, and are not explained here in any more detail.

The arrangement 300 shows a prototype of a hearing aid with a spiral antenna 210 affixed to it. The prototype has been simulated using an electro-magnetic field simulator, and cut out of self-adhesive copper foil and bonded to the hearing aid. The feed to the two radiators 110, 112 is worth noting here. The two feed points 122, 132 have feedthroughs at which the electrical connections from the outer ends 124, 134 of the two spirals 120, 130 are fed into the inside of the hearing aid. The gap d between the two feed points is about half the diameter of the two spirals. Hence, the gap between the two feed points is greater than would be expected with a conventional dipole arrangement. Apart from this, it should be noted that the minimum gap between the first spiral 120 and the second spiral 130 will preferably lie between 0.3 times the diameter of a spiral and 0.5 times the diameter of a spiral. This will ensure that a suitable coupling is guaranteed between the spirals, which is adequate to permit optimal radiation.

The gap d between the two feed points 122, 132 is typically less than the diameter of the first spiral 110, and is also less than the diameter of the second spiral 112. It is, for example, preferred that the gap d between the two feed points 122, 132 is in the range between 0.25×dMIN and 0.75×dMIN, where dMIN defines the diameter of the smaller of the two spirals 110, 112, or is equal to the diameter of the two spirals if the two spirals 110, 112 have the same diameter.

It is further preferred that the two spirals 110, 112 are designed in such a way that a direction tangential to the first spiral 120 at the first end 124, i.e. a direction which defines the alignment of the spiral at its first end 124, and a direction tangential to the second spiral 130 at the second end 134, enclose an acute angle which is not greater than 30°. In other words, at their outer ends 124, 134, or in the region of their feed points 122, 132, as applicable, the two spirals 110, 112 have approximately the same alignment. Hence in the region of the feed points 122, 132 the currents in the two spirals 110, 112 flow in approximately the same directions, with the effect that the radiation from the two spirals 110, 112 is maximized in the region of the feed points 122, 132.

With a further preferred exemplary embodiment, the gap between the two feed points 122, 132 is in a range between 0.4 times the diameter of one of the two spirals 110, 112 and 0.6 times the diameter of the appropriate spiral 110, 112.

An appropriate construction ensures that in other respects the two spirals 110, 112 function as the two arms of a dipole antenna.

Figure 4A:
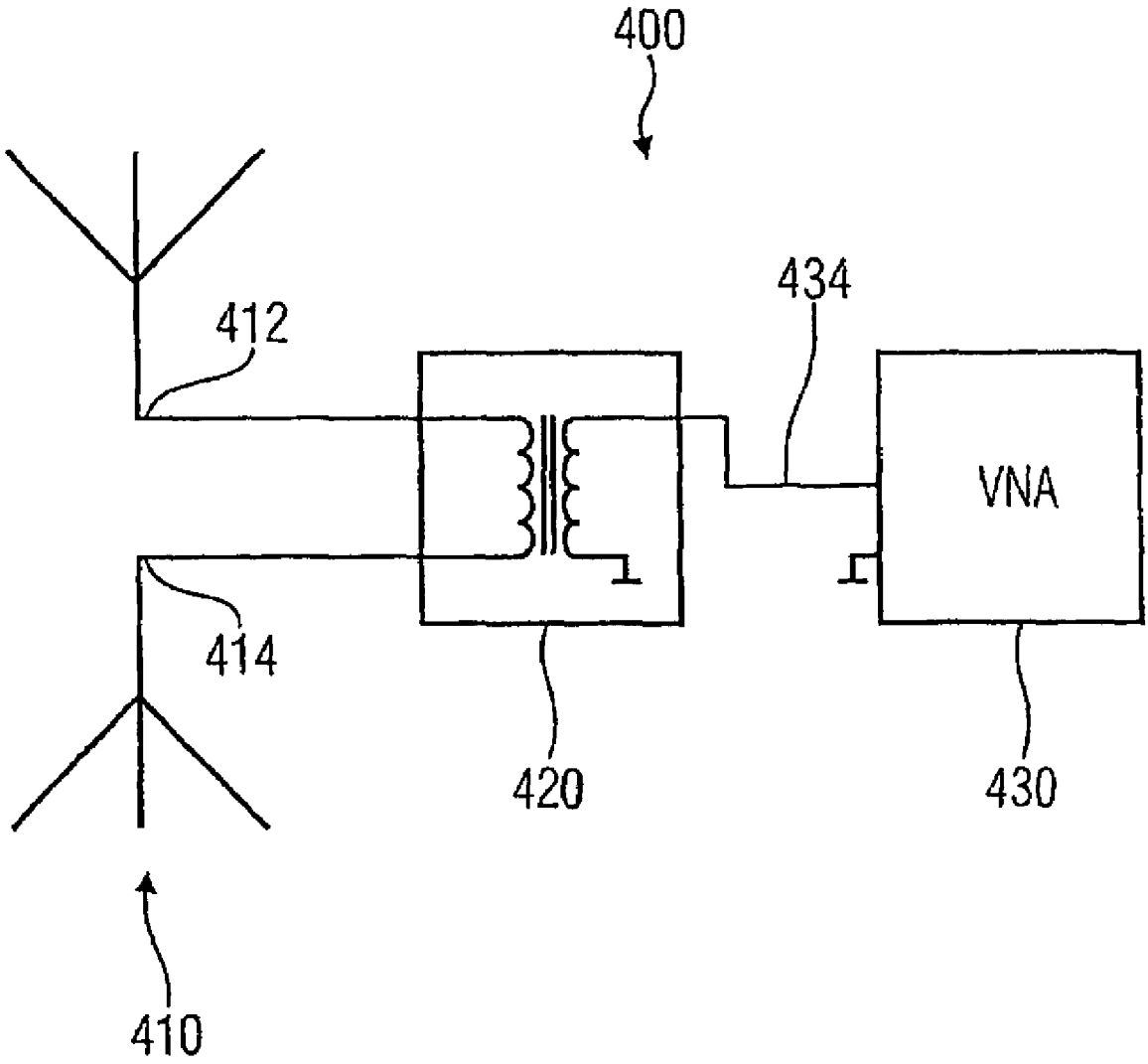
FIG. 4*a* a block diagram of an electrical test rig for determining the input reflection factor of an antenna in accordance with the invention.

FIG. 4*a* shows a block diagram of an electrical test rig for determining the input reflection factor of an antenna in accordance with the invention. The entirety of the test rig is labeled 400.

The test rig includes an antenna 410 in accordance with the invention. At its feed points 412, 414, this has approximately symmetrical electrical characteristics. For this reason, the antenna is coupled to a network analyzer 430 via a balun 420. Here the balun 420 includes, for example, a balun transformer so that on the network analyzer side an asymmetrical signal 434 is available. Depending on the test data required, the network analyzer 430 can be a scalar network analyzer or a vector network analyzer.

Figure 4B:
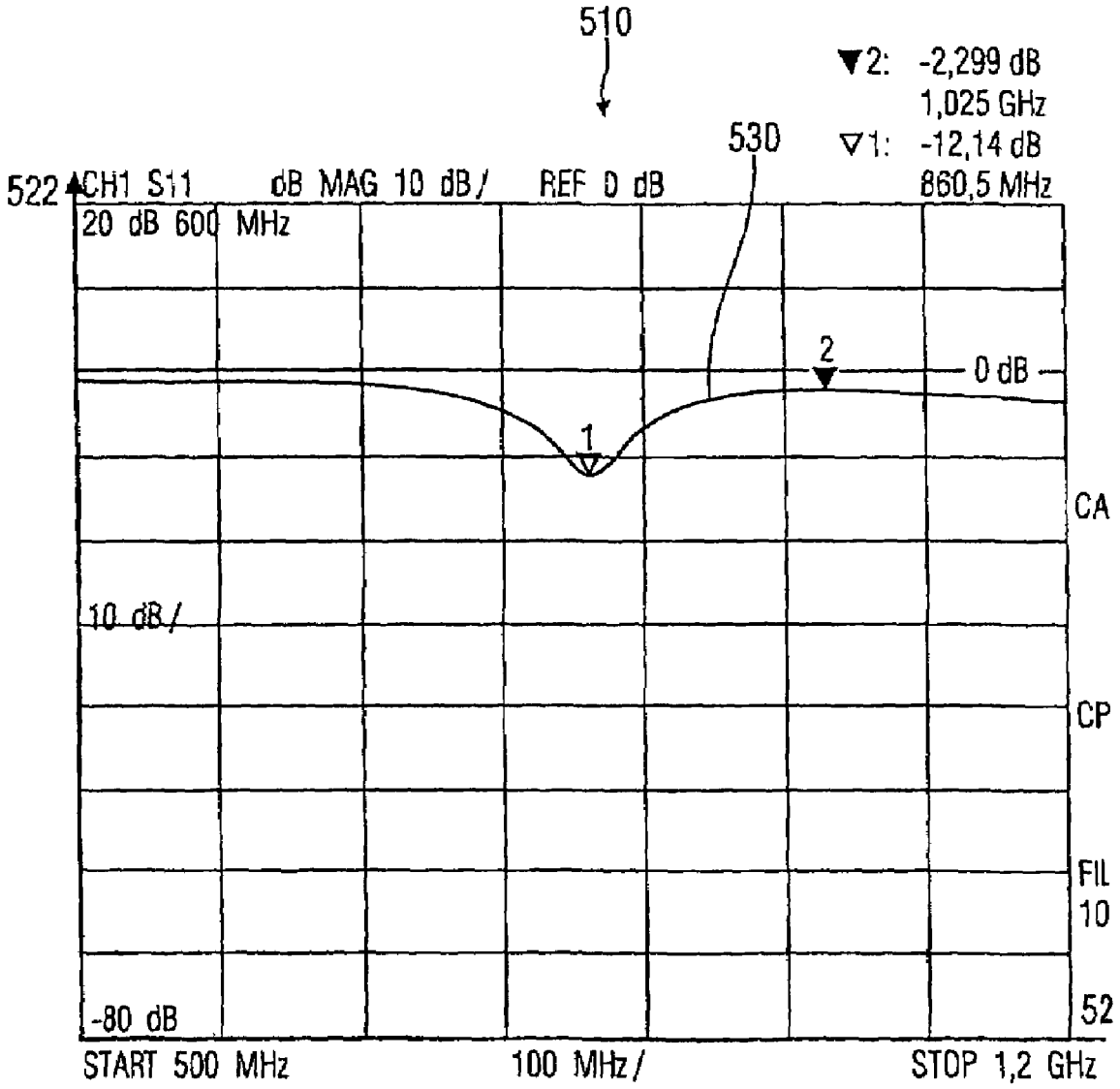
FIG. 4*b* a graph of the logarithm of the input reflection factor against frequency for an antenna in accordance with the invention, in accordance with one exemplary embodiment of the present invention.

FIG. 4*b* shows a graph of the logarithm of the input reflection factor (or return loss, as appropriate) against frequency for an antenna in accordance with the invention, in accordance with an exemplary embodiment of the present invention. During its manufacture, the prototype of the antenna in accordance with the invention which was tested was cut out from a self-adhesive copper foil, and bonded to a hearing aid. An example of a prototype of this nature is shown in FIG. 3. For the measurement of the return loss, i.e. the logarithm of the input reflection factor, the antenna 410 was connected to the network analyzer 430 via a discrete balun 420, as per the test rig 400 (cf. FIG. 4*a*). Furthermore, during the measurements the hearing aid 240 with the antenna 210 bonded on it was worn on the ear of a subject, in order to take into account also the effects of the human head or ear, as applicable, on the characteristics of the antenna. The results of the measurements are shown in the graph 510. Here, the frequency in a range from 500 MHz up to 1200 MHz is plotted on the a bscissa 520. The ordinate 522 shows the return loss in the range from −80 dB up to +20 dB. The measured return loss as a function of the frequency can be seen from the curve 530. Here, the return loss shows a clear maximum at about 860 MHz, with a −10 dB bandwidth for the return loss amounting to about 35 MHz. The maximum achievable return loss amounts to about 12 dB. Away from the payload frequency, the return loss falls back to about 2 to 3 dB. This indicates a low radiation from the antenna 410.

So, as expected the antenna only radiates effective power in a frequency interval around the design frequency. The −10 dB bandwidth of about 35 MHz corresponds to a relatively usable bandwidth of about 4 percent.

The present invention thus specifies a new type of antenna for wireless speech and data transmission. The antenna in accordance with the invention has been conceived in particular for very small devices such as hearing aids, which are worn behind the ear. It is especially well suited for mobile transmitting and receiving. A special merit of the symmetric spiral antenna in accordance with the invention consists in the fact that it can be integrated in a comparatively simple way into an existing system, for example a hearing aid. Because the antenna can be integrated into a plastic housing, it can be made so that it is completely invisible from outside. Furthermore, the antenna can be realized with a comparatively small size, and permits symmetric feeding. Apart from this, the antenna structure in accordance with the invention can also be integrated into a metal surface as a slot antenna.

The antenna in accordance with the invention is especially well suited for integration into a hearing aid. However, because of its small physical size and the ability to integrate it into a plastic housing, other application areas can be conceived for an antenna in accordance with the invention, such as for example pagers and mobile telephones.

The invention claimed is:

1. An antenna for wireless data transmission, comprising:

a first radiator that comprises a first spiral with a first feed point at an outer end of the first spiral and an open-circuit end at an inner end of the first spiral and functions as a first arm of a dipole antenna; and a second radiator that comprises a second spiral with a second feed point at an outer end of the second spiral and an open-circuit end at an inner end of the second spiral and functions as a second arm of the dipole antenna, wherein the first radiator and the second radiator are configured to:

have a spatial gap between the first and the second radiators minimum in a range between 0.3 and 0.5 times a diameter of one of the first and the second spirals, be coiled identically, lie in a same plane or on a same material surface, have a gap between the first feed point and the second feed point minimum of $5*10^{-3}$ times a freespace wavelength at an operating frequency of the antenna.

2. The antenna as claimed in claim 1, wherein the gap between the first feed point and the second feed point is in a range between 0.4 and 0.6 times a diameter of one of the first spiral and the second spiral.

3. The antenna as claimed in claim 1, wherein a gap between a center of gravity of the first spiral and a center of gravity of the second spiral is greater than a hypotenuse of a right-angled triangle in which a first cathete has a length equal to half diameter of the first spiral and a second cathete has a length equal to half diameter of the second spiral.

4. The antenna as claimed in claim 3, wherein the center of gravity of the first spiral and the center of gravity of the second spiral are geometric centers of gravity of lines which follow a course of the first spiral and a course of the second spiral respectively.

5. The antenna as claimed in claim 1, wherein:

the first spiral comprises a first spiral substrate area and a first spiral axis, the second spiral has a second spiral substrate area and a second spiral axis, a parallel projection of the first spiral substrate area in a direction of the first spiral axis does not intersect with the second spiral substrate area, and a parallel projection of the second spiral substrate area in a direction of the second spiral axis does not intersect with the first spiral substrate area.

6. The antenna as claimed in claim 1, wherein the first radiator and the second radiator are electrically conductive.

7. The antenna as claimed in claim 1, wherein the first radiator and the second radiator are radiating slots.

8. The antenna as claimed in claim 1, wherein electrical characteristics at the first feed point and the second feed point are essentially symmetrical in relation to a reference potential.

9. The antenna as claimed in claim 1, wherein the first radiator and the second radiator are arranged on a surface of a dielectric material.

10. The antenna as claimed in claim 9, wherein the surface of the dielectric material is domed.

11. The antenna as claimed in claim 1, wherein the first radiator and the second radiator are integrated into a housing that comprises a dielectric material and houses an electronic circuit.

12. The antenna as claimed in claim 11, wherein the housing is a part of a behind-the-ear hearing aid.

13. The antenna as claimed in claim 1, wherein the operating frequency of the antenna is in a range between 500 MHz and 6 GHz.

14. The antenna as claimed in claim 1, wherein a maximum dimension of the antenna is 10 cm.

15. The antenna as claimed in claim 1, wherein a maximum dimension of the antenna is less than one fifth of the freespace wavelength at the operating frequency of the antenna.

16. The antenna as claimed in claim 1, wherein the antenna is used to wirelessly transmit data to a hearing aid.

* * * * *